United States Patent [19]

Luther et al.

[11] 3,955,506

[45] May 11, 1976

[54] PROPULSIVE-CHARGE CASE

[75] Inventors: Hans Werner Luther, Buttgen; Peter Bender, Dusseldorf, both of Germany

[73] Assignee: Rheinmetall G.m.b.H., Dusseldorf, Germany

[22] Filed: Jan. 18, 1974

[21] Appl. No.: 434,589

[30] Foreign Application Priority Data

Jan. 26, 1973 Germany ..... 2303790

[52] U.S. Cl. ..... 102/43 P; 102/43 R

[51] Int. Cl.[2] ..... F42B 5/30; F42B 7/06

[58] Field of Search ..... 102/43 P, 44, 43, 38, 102/39, 40

[56] References Cited

UNITED STATES PATENTS

| | | | |
|---|---|---|---|
| 315,074 | 6/1943 | Tricou | 102/43 P |
| 3,026,802 | 3/1962 | Barnet et al. | 102/43 P |
| 3,099,958 | 7/1963 | Daubenspeck et al. | 102/43 P |
| 3,105,439 | 10/1963 | Young, Jr. | 102/43 P |

FOREIGN PATENTS OR APPLICATIONS

| | | | |
|---|---|---|---|
| 7,193 | 1891 | United Kingdom | 102/43 P |
| 919,583 | 3/1947 | France | 102/43 P |

*Primary Examiner*—Charles T. Jordan
*Attorney, Agent, or Firm*—Ernest G. Montague; Karl F. Ross; Herbert Dubno

[57] ABSTRACT

A cartridge shell has a cup-shaped metallic case stub whose rim is internally recessed to form an annular shoulder against which an inner skirt of a polymeric sealing ring, forming an extension of that rim, comes to rest while being flush with the inner cup surface. The rim portion of reduced thickness may be adhesively bonded to the skirt internally overlying same; that portion may form an annular web with an enlarged edge bead received with a snap fit in a complementary annular groove of the sealing ring separating the inner skirt from an outer skirt concentric therewith.

7 Claims, 4 Drawing Figures

PROPULSIVE-CHARGE CASE

Figure 1:
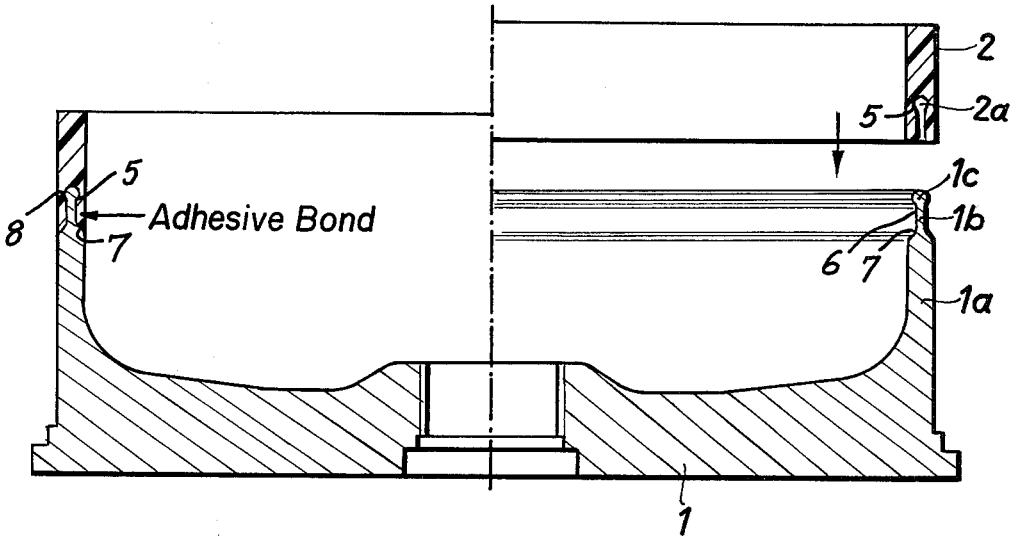

The present invention relates to a cartridge shell designed to contain a propulsive charge, comprising a unitary or multi-partite case stub provided with a resilient packing which can be pressed against the barrel wall of a firearm.

A cartridge shell is known in which a packing layer is inserted into the shell bottom simultaneously with a rolled case. The purpose of this is to create a seal at the junction between the shank of the case and the cartridge base and to relieve this junction of pressure.

In another known cartridge shell a steel collar is fastened to the inside of the shell base onto which the wound cartridge case is welded and the web of which, resting against the barrel wall, is to serve for better sealing. Aside from the fact that the steel collar is largely screened from the gas pressure by the wound case lying against it from the inside, it is scarcely suited, also from the standpoint of material, as a seal.

Finally, there is also known a cartridge in which the lower edge of the burnable body of the case is clamped in a tripartite base. Thus of the flat steel bottom is internally lined with a cup-shaped plastic shell having a cylindrical portion, corresponding to the wall of the case, against which the lower edge of the burnable cartridge body rests from the inside. A second cup-shaped shell, this one of metal, is seated on the plastic shell and by means of its cylindrical portion clamps the wall of the case between itself and the plastic shell.

Since the cylindrical portion of the plastic shell is screened by the burnable case and the metal shell from the gas pressure of the propulsive charge, a dependable seal with respect to the barrel wall cannot be obtained in this way either; this is particularly true of the plastic shell is replaced by one of metal.

It is an object of the present invention to provide an improved propulsive-charge case avoiding the above-mentioned drawbacks.

It is another object of the present invention to provide an improved propulsive-charge case wherein upon firing, a dependable seal is assured between the barrel wall of the powder chamber and the propulsive-charge case against the gas pressure which builds up within the case in every phase of pressure generation, as well as a convenient discharge of the empty case stub.

It is yet another object of the present invention to provide a propulsive-charge case, satisfying the aforestated objects, wherein the well proven combination of a metallic case stub with a burnable case can be retained and the case stub can be fired repeatedly.

We realize these objects, in accordance with our present invention, by providing the cylindrical peripheral wall of a cup-shaped body of a metallic case stub with an internal peripheral recess at its rim, forming an annular shoulder. A sealing ring of polymeric material engages this rim and constitutes an axial extension of the peripheral cup wall, its inner and outer surfaces being flush with those of the case stub. Thus, an inner skirt of the ring is received in the recess of the cup rim and rests against the annular shouler thereof while being in continuous contact with a reduced portion of the peripheral wall defined by the recess.

Advantageously, the sealing ring is adhesively bonded to the peripheral cup wall; various ways in which this can be done will be described hereinafter.

The inner skirt of the sealing ring may be concentrically surrounded by an outer skirt thereof forming with it an annular groove in which the reduced wall portion is matingly received.

Figure 2:
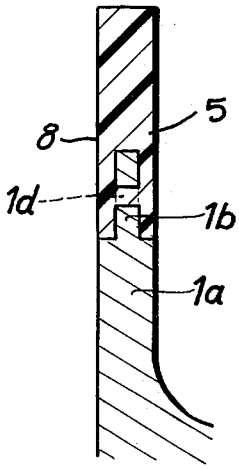
Figure 3:
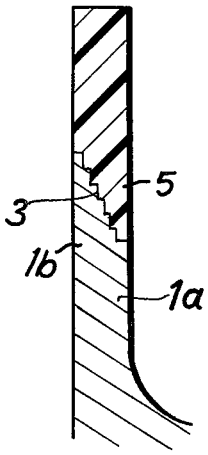
Figure 4:
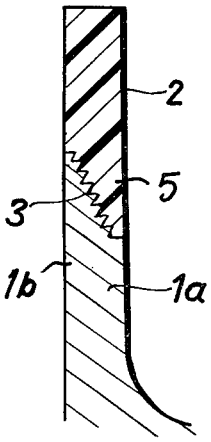

The above and other features of our invention will become apparent from the following detailed description given in conjunction with the accompanying drawing, in which:

FIG. 1 is a longitudinal section of a propulsive-charge case according to our invention with a plastic sealing ring partly broken away; and FIGS. 2–4 are fragmentary sectional views of different connections of the case with the sealing ring.

As shown in the drawing, a shell-shaped case stub 1 comprises a cup-shaped body of preferably high-quality heat-treated steel whose cylindrical peripheral wall 1*a* terminates in an annular rim in the shape of a thin-walled web 1*b* which is bonded by a circumferential bead 1*c*. A sealing ring 2, which conforms to the cross section of the peripheral wall 1*a* and can consist of a polymeric material such as, for instance, synthetic resin, natural rubber or silicone rubber, has an annular groove 2*a* which matingly receive the web 1*b* and its bead 1*c*. When the pieces are assembled, the bead 1*c* of the web 1*b* is surrounded on both sides with a snap-fastener fit by the sealing ring 2. There is also provided an additional adhesive connection between the wall 1*a* of, the case 1 and the sealing ring 2 by which the penetration of the propulsive-charge gases into the joints between case and sealing ring is prevented.

A similar connection is shown in FIG. 2 where the wall 1*a* also has a web 1*b* but the latter, instead of having a bead on its circumference, has a plurality of transverse bores 1*d* (only one shown) receiving the plastic material which penetrates therein to form plugs integral with ring 2 contributing to the anchoring of the sealing ring 2. Such a ring 2 is preferably vulcanized onto the case stub 1. This applies also to the embodiments of FIGS. 3 and 4 in which the wall 1*a* is connected with the sealing ring 2 by complementary surface formations 3 of stepped or serrated configuration.

In each instance the sealing ring 1 will be seen to have an annular skirt 5 received in an inner peripheral recess 6 of the cup wall which defines the reduced wall portion 1*b* and also forms an annular shoulder 7 against which the skirt 5 comes to rest. In FIGS. 1 and 2 the inner skirt 5 is supplemented by a concentric outer skirt 8 received in a similar recess on the outer surface of web 1*b* and forming therewith the groove 2*a*. In FIGS. 3 and 4 the reduced wall portion 1*b* and the skirt 5 are of inversely tapering cross-section with complementary angular profiles.

Of course, the sealing ring 2 can also be adhesively bonded in some other manner to the wall 1*a* of the case stub 1, as for instance by gluing, shrinking or vaporization. (cathodic sputtering).

While we have disclosed several embodiments of the present invention, it is to be understood that these are given only by way of illustration and not in a limiting sense.

We claim:

1. A cartridge shell designed to contain a propulsive charge, comprising:

a metallic case stub with a cup-shaped body having a cylindrical peripheral wall provided at its rim with an internal peripheral recess forming an annular shoulder; and a sealing ring of polymeric material engaging said rim and forming an axial extension of said peripheral wall with inner and outer surfaces flush with those of said body, said ring having an inner skirt received in said recess and resting against said shoulder, said inner skirt being in continuous contact with a reduced portion of said peripheral wall.

2. A cartridge shell as defined in claim 1 wherein said ring is adhesively bonded to said peripheral wall.

3. A cartridge shell as defined in claim 1 wherein said ring is provided with an outer skirt concentrically surrounding said inner skirt and forming an annular groove therebetween, said reduced portion being matingly received in said groove.

4. A cartridge shell as defined in claim 3 wherein said reduced portion is an annular web provided with an enlarged edge bead snap-fitted into said groove.

5. A cartridge shell as defined in claim 3 wherein said reduced portion is provided with transverse bores penetrated by polymeric plugs integral with said ring.

6. A cartridge shell as defined in claim 1 wherein said reduced portion and said inner skirt have inversely tapering cross-sections.

7. A cartridge shell as defined in claim 6 wherein said tapering cross-sections have complementary angular profiles.

* * * * *